US007006059B2

(12) United States Patent
Choi

(10) Patent No.: US 7,006,059 B2
(45) Date of Patent: Feb. 28, 2006

(54) MULTI-GRAY-SCALE IMAGE DISPLAY METHOD AND APPARATUS THEREOF

(75) Inventor: Im-Su Choi, Yangsan (KR)

(73) Assignee: Samsung SDI Co., Ltd., Suwon (KR)

( * ) Notice: Subject to any disclaimer, the term of this patent is extended or adjusted under 35 U.S.C. 154(b) by 279 days.

(21) Appl. No.: 10/187,723

(22) Filed: Jul. 1, 2002

(65) Prior Publication Data

US 2003/0011544 A1 Jan. 16, 2003

(30) Foreign Application Priority Data

Jul. 13, 2001 (KR) ..... 2001-0042414

(51) Int. Cl.
*G09G 3/28* (2006.01)

(52) U.S. Cl. ..... 345/63; 345/60; 345/64; 345/65; 345/66; 345/67; 345/69

(58) Field of Classification Search ..... 345/60–69, 345/611, 147–149, 199, 432, 89, 1.1, 406; 315/169.4; 382/118; 313/582–587; 356/1.1, 356/406; 348/699
See application file for complete search history.

(56) References Cited

U.S. PATENT DOCUMENTS 5,563,956 A * 10/1996 Nishikawa et al. ..... 382/118
5,717,605 A * 2/1998 Komiya et al. ..... 356/406
6,069,609 A * 5/2000 Ishida et al. ..... 345/596
6,310,588 B1 * 10/2001 Kawahara et al. ..... 345/63
6,456,302 B1 * 9/2002 Kawahara et al. ..... 345/693
6,495,968 B1 * 12/2002 Tokunaga ..... 315/169.4
6,661,470 B1 * 12/2003 Kawakami et al. ..... 348/699
6,710,755 B1 * 3/2004 Shiozaki et al. ..... 345/60
6,753,831 B1 * 6/2004 Ide et al. ..... 345/60
2001/0028347 A1 * 10/2001 Kawahara et al. ..... 345/204
2002/0005857 A1 * 1/2002 Kasahara et al. ..... 345/611
2002/0014848 A1 * 2/2002 Tokunaga ..... 315/169.1
2002/0018037 A1 * 2/2002 Yamada ..... 345/89
2002/0135788 A1 * 9/2002 Arakawa et al. ..... 358/1.1
2004/0021622 A1 * 2/2004 Nagao et al. ..... 345/60

FOREIGN PATENT DOCUMENTS

JP 09-097035 * 4/1997
JP 2000-163005 * 6/2000

* cited by examiner

*Primary Examiner*—Vijay Shankar
*Assistant Examiner*—Prabod M Dharia
(74) *Attorney, Agent, or Firm*—Christie, Parker and Hale, LLP

(57) ABSTRACT

A multi-gray-scale image display method and apparatus for displaying a multi-gray-scale image on a PDP by diffusing, as an error, a part of gray scale data representing an input image requiring more than a gray scale resolution of the PDP to a target pixel from different adjacent pixels in a scanning direction according to a diffusion factor corresponding to each pixel. A determination is made whether the target pixel to which the error is diffused from the adjacent pixels is positioned in an upper line of the whole image represented by the data. The diffusion factor is set such that it determines the error diffused from an adjacent pixel differently when the target pixel to which the error is diffused from the adjacent pixel is positioned in the upper line of the whole image.

18 Claims, 3 Drawing Sheets

MULTI-GRAY-SCALE IMAGE DISPLAY METHOD AND APPARATUS THEREOF

BACKGROUND OF THE INVENTION

The present invention relates to a multi-gray-scale image display method and an apparatus thereof. More specifically, the present invention relates to a multi-gray-scale image display method and an apparatus thereof that diffuses an adequate amount of error for predetermined upper lines in an image so as to increase the gray-scale image display number.

The use of a digital display device such as a plasma display panel (PDP) in multi-gray-scale image display may degrade the image quality, because multi-gray-scale image display may be beyond the ability of the display device. The gray scale image display number that is subjected to restriction due to physical limitations of the digital display device can be increased by a so-called error diffusion method that uses a spatially averaged gray scale with neighboring pixels.

For example, an 8-bit gray-scale resolution display device actually displays no more than upper eight bits of a 12-bit gray-scale input image signal and leaves the lower four bits that cannot be displayed, as an error component. This error component is multiplied by a predetermined factor and is diffused to the next pixel and its adjacent pixels in the next line, to make the sum of the error components zero over all the pixels as if a 12-bit gray scale image is displayed.

Japanese Patent Application 2000-163005 discloses a conventional multi-gray-scale image display method capable of error diffusion for every piece of digital data even when digital data are input for multiple images.

However, the error diffusion according to the conventional method may lead to missing some of the upper lines. For example, in the error diffusion of the conventional method that is performed equally for all lines of the image, normal error diffusion does not occur in the first line and the gray scale of the first line differs from that of the other lines, because there is no line previous to the first line and hence no error diffusion from the previous line. Similarly, such an abnormal error in the first line is diffused to the second and all the way to about tenth lines.

Particularly, in low-gray-scale image display, about ten upper lines to which an extremely small amount of error is diffused from the previous line are processed as zero by rounding. These about ten upper lines are not displayed at all in the image, thus, the actual size of the image displayed is reduced.

To prevent the line-missing caused by the error diffusion, a method is used to a larger image as shown in FIG. 1, in which the size of the input image is greater by the number of missing lines. However, the method is problematic in that the same image is displayed in different sizes for a display device using error diffusion (e.g., a plasma display panel) and a display device not using error diffusion (e.g., a cathode ray tube).

SUMMARY OF THE INVENTION

A feature of one embodiment of the present invention is to provide a multi-gray-scale image display method and an apparatus thereof that diffuses an adequate amount of error for a predetermined upper line in performing error diffusion so as to increase the gray scale image display number, thereby displaying the whole image in real size.

In one embodiment of the present invention, a multi-gray-scale image display method is provided for displaying a multi-gray-scale image on a plasma display panel by diffusing, as an error, a part of gray scale data of an input image signal requiring more than a predetermined gray scale resolution of the plasma display panel to a target pixel from different adjacent pixels in a scanning direction according to a diffusion factor corresponding to each pixel. The diffusion factor is set such that it determines the error diffused from an adjacent pixel differently according to whether the target pixel to which the error is diffused from the adjacent pixel is positioned in a predetermined upper line of the whole image. The diffusion factor is also set such that it determines the error diffused from the adjacent pixel differently according to whether the error component of the gray scale data of the input image signal corresponds to a predetermined low gray scale.

In one embodiment of the present invention, a multi-gray-scale image display apparatus is provided including: an analog-to-digital converter for converting an input analog image signal requiring more than a predetermined gray scale resolution of a plasma display panel to digital data; an error diffuser for diffusing, as an error, a part of the digital data having a predetermined number of bits output from the analog-to-digital converter to a target pixel from different adjacent pixels in a scanning direction according to a diffusion factor corresponding to each pixel, and outputting pixel data having a number of bits suitable for the predetermined gray scale resolution of the plasma display panel. The diffusion factor is set differently according to whether the target pixel to which the error is diffused from the adjacent pixels is positioned within a predetermined upper line in the whole image. A subfield information generator assigns a predetermined brightness weight to the image data output from the error diffuser to generate subfield information. A display controller displays a corresponding image on the plasma display panel according to the subfield information generated by the subfield information generator.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION

In the following detailed description, as will be realized, the invention is capable of modification in various obvious respects, all without departing from the invention. Accordingly, the drawings and description are to be regarded as illustrative in nature, and not restrictive.

Figure 2:
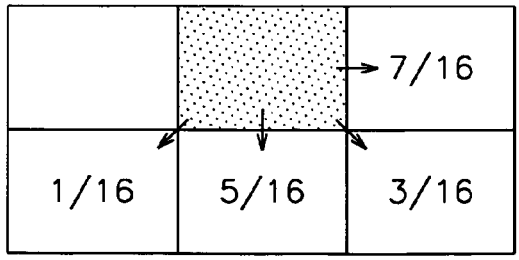
FIG. 2 is an illustration showing a general error diffusion pattern.
Figure 3:
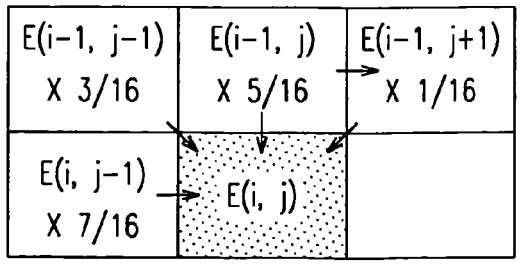
FIG. 3 is an illustration showing that an error is diffused to the current pixel according to the general error diffusion pattern.

FIG. 2 is an illustration of a general error diffusion pattern, and FIG. 3 shows how an error is diffused to the current pixel according to the general error diffusion pattern.

As shown in FIG. 2, the general error diffusion pattern diffuses 7/16 of a display error from the current pixel to the pixel to the right, 1/16 to the bottom left pixel, 5/16 to the bottom middle pixel, and 3/16 to the bottom right pixel.

FIG. 3 shows that the error concentrated on the current pixel is diffused from the respective adjacent pixels. Namely, part of the error is diffused to the current pixel from the three adjacent pixels of the previous line and from the previous pixel of the same line.

More specifically, if the matrix data of the current pixel is E(i, j), 3/16 of the display error is diffused to the current pixel E(i, j) from the left pixel E(i−1, j−1) of the previous line, 5/16 from the middle pixel E(i−1, j) of the previous line, 1/16 from the right pixel E(i−1, j+1) of the previous line, and 7/16 from the previous pixel E(i, j−1) of the same line.

Figure 4:
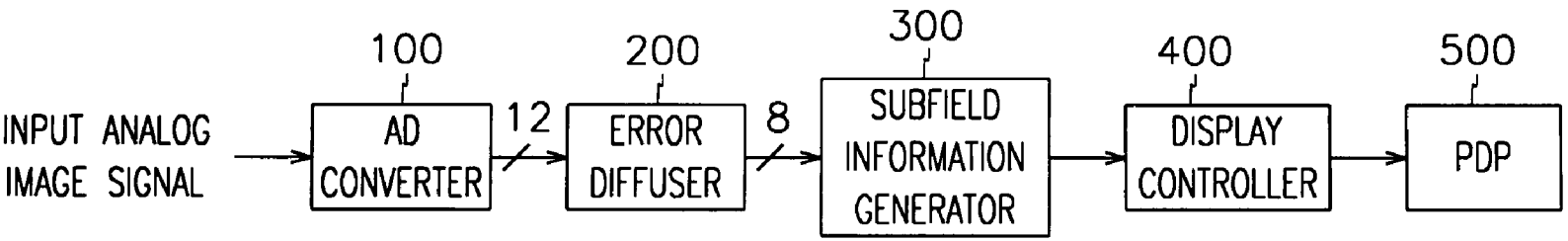
FIG. 4 is a block diagram of a multi-gray-scale image display apparatus according to an embodiment of the present invention.

FIG. 4 is a block diagram of a multi-gray-scale image display apparatus according to an embodiment of the present invention. As shown in FIG. 4, the multi-gray-scale image display apparatus comprises an analog-to-digital (AD) converter 100, an error diffuser 200, a subfield information generator 300, a display controller 400, and a plasma display panel (PDP) 500.

The AD converter 100 converts a serial analog input signal to digital data having a predetermined number of bits, e.g., 12-bit digital data.

The error diffuser 200 diffuses the display error of the 12-bit digital data converted by the AD converter 100 to the adjacent pixels, and outputs 8-bit pixel data. Such an operation in the unit of TV fields is performed based on vertical synchronous signals.

The subfield information generator 300 assigns a predetermined brightness weight to the 8-bit pixel data output from the error diffuser 200 to generate 8-bit subfield information, and records the 8-bit subfield information in a built-in frame memory. Here, a look-up table may be used to map different gray scales of the pixel data output from the error diffuser 200 to gray scale values after conversion.

The display controller 400 displays an image on the PDP 500 according to the subfield information generated and recorded by the subfield information generator 300.

The components 100, 300, 400 and 500 of the multi-gray-scale image display apparatus according to the embodiment of the present invention except for the error diffuser 200 are the same in general features as those of the conventional multi-gray-scale image display apparatus, and are well known to those skilled in the art. Therefore, a detailed description will now be given only to the error diffuser 200.

Figure 5:
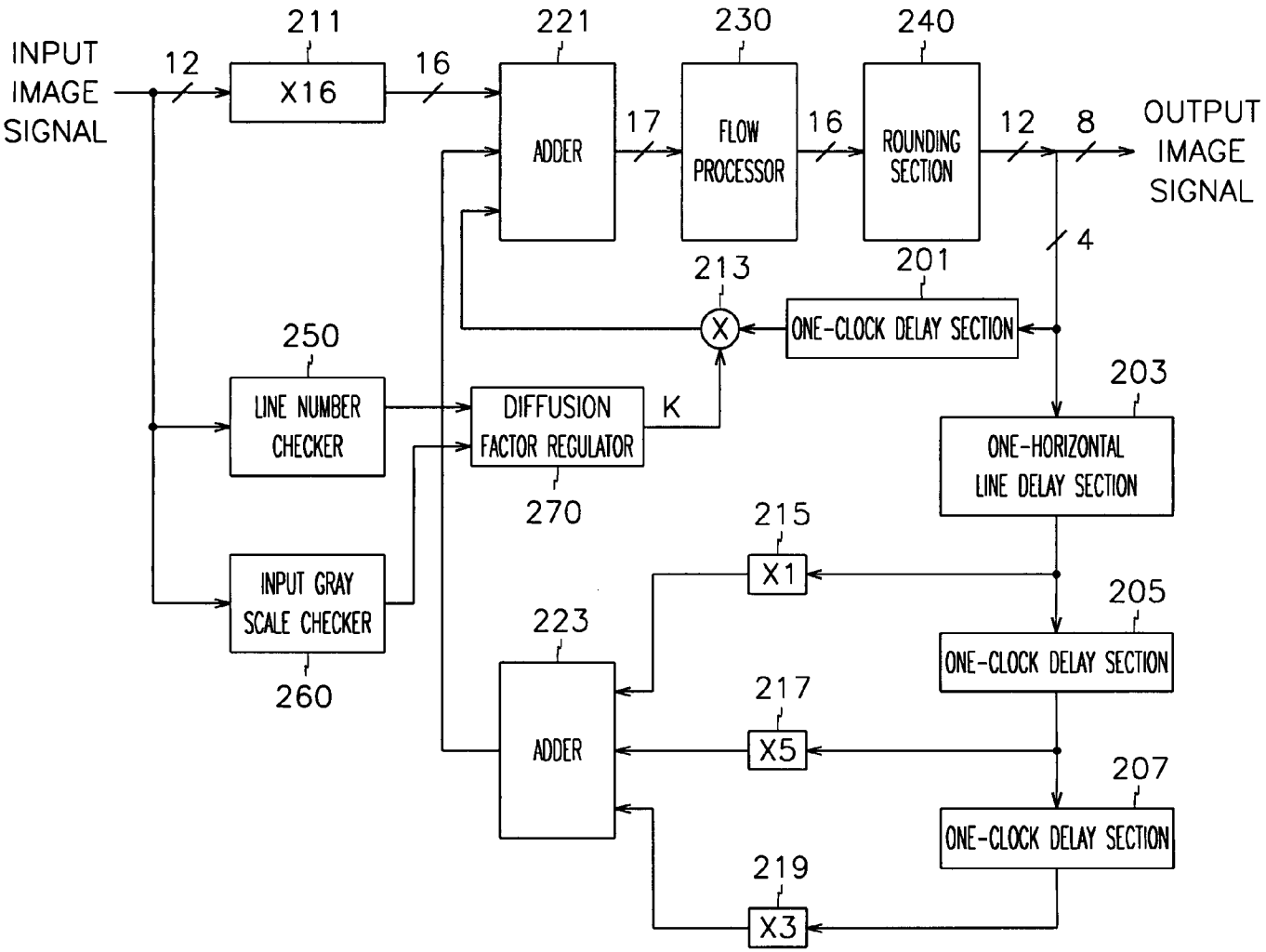
FIG. 5 is a detailed block diagram of an error diffuser in the multi-gray-scale image display apparatus according to an embodiment of the present invention.

FIG. 5 is a detailed block diagram of the error diffuser 200 in the multi-gray-scale image display apparatus according to an embodiment of the present invention.

As shown in FIG. 5, the error diffuser 200 comprises delay sections 201, 203, 205, and 207; factor sections 211, 213, 215, 217, and 219; adders 221 and 223; a flow processor 230; a rounding section 240; a line number checker 250; an input gray scale checker 260; and a diffused gray scale regulator 270.

Figure 1:
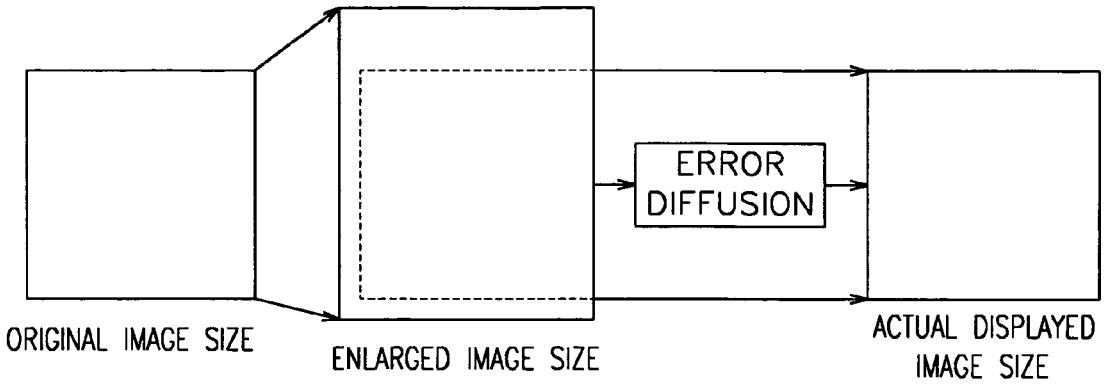
FIG. 1 is an illustration showing that an enlarged image is used in order to compensate for missing lines.

The error diffusion pattern of the error diffuser 200 corresponds to the pattern shown in FIG. 1. The factor section 211 has a factor of 16, the factor section 215 has a factor of 1, the factor section 217 has a factor of 5, and the factor section 219 has a factor of 3.

First, when a 12-bit input image signal is applied, the factor section 211 multiplies the input image signal by a factor of 16 so as to increase the numerical operation resolution. Multiplying the input image signal by 16 ($=2^4$) increases the number of bits of the input image signal by four. For example, if the input image signal is xxxxxxxx.xxxx, the output signal of the factor section 211 is xxxxxxxx.xxxxxxxx.

The image signal of which the number of bits is increased by the factor section 211 is fed into the adder 221, which adds the 8-bit error component of the input image signal from the factor section 211 to the error component diffused from the previous pixel of the same line, and from the left, middle, and right pixels of the previous line, and outputs the sum of the error components to the flow processor 230. The flow processor 230 processes occurrence of overflow or underflow in such a manner that it processes the sum of the error components from the adder 221 as "11111111" when the sum is greater than "11111111" and exceeds 8 bits, and as "00000000" when the sum is less than "00000000" and has a negative value. The resulting image signal from the flow processor 230 is output to the rounding section 240.

The rounding section 240 rounds the image signal according to the value of the fourth lower bit so as to restore the number of bits of the error component from eight to four. For example, when the image signal from the flow processor 230 is xxxxxxxx.xxxx1xxx in which the value of the fourth lower bit is "1", the rounding section 240 adds "1" to the 12-bit image signal for rounding, i.e., as "xxxxxxxx.xxxx+1". When the image signal from the flow processor 230 is xxxxxxxx.xxxx0xxx in which the value of the fourth lower bit is "0", the rounding section 240 discards the four lower bits and outputs the 12-bit image signal as it is.

By way of error diffusion to the current pixel from adjacent pixels, only eight upper bits among the 12 bits of the image signal from the rounding section 240 are output to the subfield information generator 300 and displayed as a corresponding image on the PDP 500, as shown in FIG. 4.

The four lower bits among the 12 bits of the image signal output from the rounding section 240 are input to the delay sections 201 and 203 for error diffusion to the next adjacent pixels.

First, the four bits of the error component of the current pixel output from the rounding section 240 are input to the one-clock-delay section 201 for error diffusion to the adjacent pixel. The one-clock-delay section 201 delays the error component by one clock signal and outputs the delayed error component to the factor section 213.

In the case of error diffusion equally performed to all the pixels of one image, line-missing occurs on the upper lines especially in a low gray scale image display. To prevent line-missing, it is necessary to check if the line positioned at the current pixel is within a predetermined upper line, particularly, the fifth upper line. The line number checker 250 checks the number of the line positioned at the current pixel from the input image signal and outputs the result to the diffusion factor regulator 270.

To prevent line-missing during the low gray scale image display, it is also necessary to check if the gray scale for the four lower bits of the input image signal correspond to a low gray scale, particularly ranging from "0000" to "0101". The input gray scale checker 260 checks the gray scale of the current pixel from the input image signal and outputs the result to the diffusion factor regulator 270.

The diffusion factor regulator 270 receives the output of the line number checker 250 concerning the number of the line at the current pixel and that of the input gray scale checker 260 concerning whether the gray scale for the current pixel corresponds to a low gray scale, and regulates the factor used for multiplication of the output signal from the one-clock-delay section 201.

For example, when the current pixel has a low gray scale ranging from "0000" to "0101" and is positioned in the first line, the factor K is regulated to 16 to maximize the size of the error applied to the current pixel. Similarly, the factor K is regulated to 12 for the low-level gray scale pixel positioned in the second line, to 10 for the low-level gray scale pixel positioned in the third line, to 8 for the low-level gray scale pixel positioned in the fourth line, and to 7 for the low-level gray scale pixel positioned in the fifth line. The factor decreases with an increase in the number of the line starting from the first upper line. The factor is at a maximum in the first line, because abnormal diffusion occurs as there is no line previous to the first line, and hence no error diffusion from the previous line. Similarly, the diffusion factor decreases from the first line, since the error diffusion effect increases with an increase in the number of the previous lines.

Though the factors within the fourth upper line are regulated differently from those of the lower lines, the range of factor regulation can be beyond the limits, for example, within the tenth upper line.

Though both the line number of the current pixel and whether the current pixel has a low gray scale are considered in performing error diffusion, the two conditions may be separately applied to the error diffusion.

The factor section 213 multiplies the output signal of the one-clock-delay section 201 by the factor K determined by the diffusion factor regulator 270 and inputs the result to the adder 221 so as to diffuse the error component of the current pixel to the next adjacent pixels. In this regard, the error component output from the factor section 213 is added to the error component of the image signal of which the number of bits is increased by 4 via the factor section 211, so that the error component of the previous pixel is diffused to the current pixel by K/16.

The four bits of the error component of the current pixel output from the rounding section 240 are input to the one-horizontal-line delay section 203 for error diffusion to the adjacent pixel of the next line. The one-horizontal-line delay section 203 delays the error component by one horizontal line and outputs the delayed error component to the factor section 215 and the one-clock-delay section 205.

The one-horizontal-line delay section 203 comprises a line buffer of a one-horizontal-line storage size for diffusing the error component of the pixel in the current line to the next line.

The factor section 215 multiplies the error component output from the one-horizontal-line delay section 203 by 1 and outputs the multiplied error component to the adder 223. This operation is to diffuse 1/16 of the error component of the current pixel to the left pixel of the next line.

The one-clock-delay section 205 delays the error component from the one-horizontal-line delay section 203 by one clock signal and outputs the delayed error component to the factor section 217 and the one-clock-delay section 207.

The factor section 217 multiplies the error component output from the one-clock-delay section 205 by 5 and outputs the multiplied error component to the adder 223. This operation is to diffuse 5/16 of the error component of the current pixel to the middle pixel of the next line.

Subsequently, the one-clock-delay section 207 delays the error component from the one-horizontal-line delay section 205 by one clock signal and outputs the delayed error component to the factor section 219.

The factor section 219 multiplies the error component output from the one-clock-delay section 207 by 3 and outputs the multiplied error component to the adder 223. This operation is to diffuse 3/16 of the error component of the current pixel to the right pixel of the next line. The adder 223 outputs the sum of the error components diffused to the current pixel from the left, middle, and right pixels of the previous line to the adder 221.

As described above, one embodiment of the present invention transmits an adequate amount of error, according to the number of the predetermined upper line and whether the input image signal has a low gray scale, in error diffusion to increase the gray scale display number, thereby preventing line-missing. Furthermore, line-missing is prevented, and thereby there is displayed the whole image in real size from the actual image data.

One or more embodiments of the invention have been described, it is to be understood that the invention is not limited to the disclosed embodiments, but, on the contrary, is intended to cover various modifications and equivalent arrangements included within the spirit and scope of the appended claims.

What is claimed is:

1. A multi-gray-scale image display method for displaying a multi-gray-scale image on a plasma display panel (PDP) by diffusing, as an error, a part of gray scale data of an input image requiring more than a predetermined gray scale resolution of the PDP to a target pixel from different adjacent pixels in a scanning direction according to a diffusion factor corresponding to each pixel, the method comprising:

(a) determining if the target pixel to which the error is diffused from the adjacent pixels is positioned in a predetermined upper line at an upper part of the PDP of the input image; and (b) setting the diffusion factor that determines the error diffused from an adjacent pixel differently when the target pixel to which the error is diffused from the adjacent pixel is positioned in the predetermined upper line of the input image, wherein the diffusion factor is greater for a target pixel positioned in the predetermined upper line than for a target pixel not in the predetermined upper line.

2. The multi-gray-scale image display method as claimed in claim 1, wherein the step (b) comprises setting the diffusion factor that determines the error diffused from the adjacent pixel according to whether the error component of the gray scale data of the input image corresponds to a predetermined low gray scale.

3. The multi-gray-scale image display method as claimed in claim 2, wherein the adjacent pixel includes a predetermined pixel positioned in a same line before the target pixel, and three predetermined pixels adjacent to the target pixel and positioned in a previous line.

4. The multi-gray-scale image display method as claimed in claim 3, wherein the predetermined upper line ranges from the first upper line to the fourth upper line in the input image.

5. The multi-gray-scale image display method as claimed in claim 4, wherein the diffusion factor decreases as the target pixel moves from the first upper line to the fourth upper line.

6. A multi-gray-scale image display apparatus comprising:

an analog-to-digital converter for converting an input analog image signal requiring more than a predetermined gray scale resolution of a plasma display panel to digital data, and outputting the same;

an error diffuser for diffusing, as an error, part of the digital data to a target pixel from different adjacent pixels in a scanning direction according to a diffusion factor corresponding to each pixel, and outputting pixel data having a number of bits suitable for the predetermined gray scale resolution of the plasma display panel, the diffusion factor being set according to whether the target pixel to which the error is diffused from the adjacent pixels is positioned within a predetermined upper line at an upper part of the plasma display panel in the whole image;

a subfield information generator for assigning a predetermined brightness weight to the pixel data output from the error diffuser to generate subfield information; and a display controller for displaying a corresponding image on the plasma display panel according to the subfield information generated by the subfield information generator, wherein the error diffuser sets the diffusion factor to be greater for the target pixel positioned in the predetermined upper line than for the target pixel not in the predetermined upper line.

7. The multi-gray-scale image display apparatus as claimed in claim 6, wherein the error diffuser sets the diffusion factor according to whether an error component as part of a lower data of the digital data corresponds to a predetermined low gray scale, when the target pixel to which the error is diffused from the adjacent pixels is positioned within the predetermined upper line of the input image.

8. The multi-gray-scale image display apparatus as claimed in claim 7, wherein the error diffuser comprises:

a target pixel data determiner for determining the pixel data of the target pixel according to the digital data output from the analog-to-digital converter and the error diffused from the adjacent pixels, and outputting predetermined upper data of the pixel data to the subfield information generator;

an error diffusion executor for diffusing, as an error, the lower data of the pixel data output from the target pixel data determiner other than the predetermined upper data according to a diffusion factor corresponding to each adjacent pixel, and outputting the result to the target pixel data determiner;

a line number checker for receiving the digital data from the analog-to-digital converter, and checking the number of a line on which the target pixel is positioned in the input image;

an input gray scale checker for receiving the digital data from the analog-to-digital converter and checking whether the predetermined lower data corresponding to the error of the digital data corresponds to a predetermined low gray scale data; and a diffusion factor regulator for regulating the diffusion factor according to a line number output from the line number checker and the low gray scale data output from the input gray scale checker, and outputting the regulated diffusion factor to the error diffusion executor.

9. The multi-gray-scale image display apparatus as claimed in claim 8, wherein the target pixel data determiner comprises:

an adder for adding an error component diffused from the adjacent pixel to the error component being part of the digital data output from the analog-to-digital converter, and outputting the result;

a flow processor for performing overflow or underflow of the data output from the adder; and a rounding section for rounding the predetermined lower data of the output data of the flow processor and outputting predetermined upper data of the generated data to the subfield information generator.

10. The multi-gray-scale image display apparatus as claimed in claim 9, wherein the diffusion factor regulator regulates the diffusion factor for error diffusion on the same line.

11. The multi-gray-scale image display apparatus as claimed in claim 10, wherein the predetermined upper line ranges from the first upper line to the fourth upper line in the whole image.

12. The multi-gray-scale image display apparatus as claimed in claim 11, wherein the diffusion factor decreases as the target pixel moves from the first upper line to the fourth upper line.

13. A method for displaying a multi-gray-scale image on a plasma display panel (PDP) comprising:

diffusing, as an error, a part of gray scale data of an input image requiring more than a predetermined gray scale resolution of the PDP to a target pixel from an adjacent pixel according to a diffusion factor;

determining if the target pixel to which the error is diffused from the adjacent pixel is positioned in a predetermined upper line at an upper part of the PDP of the input image; and setting the diffusion factor that determines the error diffused from the adjacent pixel to a new value when the target pixel is positioned in the predetermined upper line of the input image, wherein the diffusion factor is greater for a target pixel positioned in the predetermined upper line than for other target pixels.

14. The method of claim 13, wherein the setting step comprises setting the diffusion factor to the new value according to whether the error component of the gray scale data of the input image corresponds to a predetermined low gray scale.

15. The method of claim 14, wherein the adjacent pixel includes a predetermined pixel positioned in a same line before the target pixel, and three predetermined pixels adjacent to the target pixel and positioned in a previous line.

16. The method of claim 13, wherein the adjacent pixel is a group of pixels adjacent to the target pixel.

17. A method for displaying a multi-gray-scale image on a plasma display panel (PDP) comprising:

diffusing, as an error, a part of gray scale data of an input image to a target pixel from an adjacent pixel according to a diffusion factor determining if the target is positioned in a predetermined line of the input image; and setting the diffusion factor to a new value when the target pixel is positioned in the predetermined line of the input image, wherein the diffusion factor is greater for a target pixel positioned in the predetermined line than for other target pixels, wherein the setting step comprises setting the diffusion factor to the new value according to whether the error component of the gray scale data of the input image corresponds to a predetermined low gray scale, wherein the adjacent pixel includes a predetermined pixel positioned in a same line before the target pixel, and three predetermined pixels adjacent to the target pixel and positioned in a previous line, and wherein the predetermined line ranges from the first upper line to the fourth upper line in the input image.

18. The method of claim 17, wherein the diffusion factor decreases as the target pixel moves from the first upper line to the fourth upper line.

* * * * *